US006365095B1

(12) United States Patent
Bergkvist

(10) Patent No.: US 6,365,095 B1
(45) Date of Patent: Apr. 2, 2002

(54) WARM COMPACTION OF STEEL POWDERS

(75) Inventor: Anders Bergkvist, Helsingborg (SE)

(73) Assignee: Höganäs AB, Hoganas (SE)

( * ) Notice: Subject to any disclaimer, the term of this patent is extended or adjusted under 35 U.S.C. 154(b) by 0 days.

(21) Appl. No.: 09/767,740

(22) Filed: Jan. 24, 2001

Related U.S. Application Data

(63) Continuation of application No. PCT/SE99/01636, filed on Sep. 17, 1999.

(30) Foreign Application Priority Data

Sep. 18, 1998 (SE) ..... 9803171

(51) Int. Cl.[7] ..... B22F 3/14

(52) U.S. Cl. ..... 419/48; 419/31; 419/37; 75/252

(58) Field of Search ..... 75/252; 419/31, 419/37, 48

(56) References Cited

U.S. PATENT DOCUMENTS 4,448,746 A * 5/1984 Kubo et al. ..... 419/31
5,154,881 A 10/1992 Rutz et al. ..... 419/37
5,628,046 A * 5/1997 Dautzenberg et al. ..... 419/38
5,744,433 A 4/1998 Storström et al. ..... 508/454
5,856,625 A * 1/1999 Saunders et al. ..... 75/236

FOREIGN PATENT DOCUMENTS

| | | |
|---|---|---|
| EP | 0 378 702 | 7/1990 |
| WO | 33589 | 12/1995 |
| WO | 58093 | 12/1998 |

OTHER PUBLICATIONS

Copy of International Search Report dated Jan. 22, 2000.

* cited by examiner

*Primary Examiner*—Ngoclan Mai
(74) *Attorney, Agent, or Firm*—Burns, Doane, Swecker & Mathis, L.L.P.

(57) ABSTRACT

The present invention concerns a process of preparing high density, warm compacted bodies of a stainless steel powder comprising the steps of providing a mixture of a low carbon, low oxygen stainless steel powder including 10–30% by weight of Cr, optional alloying elements and graphite and inevitable impurities, mixing the powder with a high temperature lubricant and compacting the mixture at an elevated temperature. The invention also concerns a composition of the stainless steel powder, optional additional alloying elements and a high temperature lubricant.

27 Claims, No Drawings

WARM COMPACTION OF STEEL POWDERS

This is a continuation of International Application No. PCT/SE99/01636, filed Sep. 17, 1999 that designates the United States of America and claims priority for Swedish Application No. 9803171-9, filed Sep. 18, 1998.

FIELD OF THE INVENTION

The present invention concerns a process of warm compacting steel powder compositions as well as the compacted and sintered bodies obtained thereof. Specifically the invention concerns warm compacting of stainless steel powder compositions.

BACKGROUND ART

Since the start of the industrial use of powder metallurgical processes i.e. the pressing and sintering of metal powders, great efforts have been made in order to enhance the mechanical properties of P/M-components and to improve the tolerances of the finished parts in order to expand the market and achieve the lowest total cost.

Recently much attention has been paid to warm compaction as a promising way of improving the properties of P/M components. The warm compaction process gives the opportunity to increase the density level, i.e. decrease the porosity level in finished parts. The warm compaction process is applicable to most powder/material systems. Normally the warm compaction process leads to higher strength and better dimensional tolerances. A possibility of green machining, i.e. machining in the "as-pressed" state, is also obtained by this process.

Warm compaction is considered to be defined as compaction of a particulate material mostly consisting of metal powder above approximately 100° C. up to approximately 150° C. according to the currently available powder technologies such as Densmix, Ancorbond or Flow-Met.

A detailed description of the warm compaction process is described in e.g. a paper presented at PM TEC 96 World Congress, Washington, June 1996, which is hereby incorporated by reference. Specific types of lubricants used for warm compaction of iron powders are disclosed in e.g. the U.S. Pat. Nos. 5,154,881 and 5,744,433.

In the case of stainless steel powders it has now been found, however, the general advantages with warm compaction have been insignificant as only minor differences in e.g. density and green strength have been demonstrated. Additional and major problems encountered when warm compacting stainless steel powders are the high ejection forces and the high internal friction during compaction.

SUMMARY OF THE INVENTION

It has now unexpectedly been found that these problems can be eliminated and that a substantial increase in green strength and density can be obtained provided that the stainless steel powder is distinguished by very low oxygen, low silicon and carbon contents. More specifically the oxygen content should be below 0.20, preferably below 0.15 and most preferably below 0.10 and the carbon content should be lower than 0.03, preferably below 0.02 and most preferably below 0.01% by weight. The experiments also indicate that the silicon content is an important factor and that a silicon content should be low, preferably below about 0.5%, more preferably below 0.3% and most preferably below 0.2% by weight, in order to eliminate the problems encountered when stainless steel powders are warm compacted. Another finding is that the warm compaction of this stainless steel powder is most effective at high compaction pressures, i.e. that the density differences of the warm compacted and cold compacted bodies of this powder increase with increasing compaction pressures, which is quite contrary to the performance of standard iron or steel powders.

DETAILED DESCRIPTION OF THE INVENTION

Preferably the powders subjected to warm compaction are pre-alloyed water atomised powders which include, by percent of weight, 10–30% of chromium, 0–5% of molybdenum, 0–15% of nickel, 0–0.5% of silicon, 0–1.5% of manganese, 0–2% of niobium, 0–2% of titanium, 0–2% of vanadium, 0–5% of $Fe_3P$, 0–0.4% graphite and at most 0.3% of inevitable impurities and most preferably 10–20% of chromium, 0–3% of molybdenum, 0.1–0.3% of silicon, 0.1–0.4% of manganese, 0–0.5% of niobium, 0–0.5% of titanium, 0–0.5% of vanadium, 0–0.2% of graphite and essentially no nickel or alternatively 7–10% of nickel, the balance being iron and unavoidable impurities. The preparation of such powders is disclosed in the PCT patent application SE98/01189, which is hereby incorporated by reference.

The lubricant may be of any type as long as it is compatible with the warm compaction process. More specifically the lubricant should be a high temperature lubricant selected from the group consisting metal stearates, such as lithium stearates, paraffins, waxes, natural and synthetic fat derivatives. Also polyamides of the type disclosed in e.g. the U.S. Pat. Nos. 5,154,881 and 5,744,433, which are referred to above and which are hereby incorporated by reference, can be used. The lubricant is normally used in amounts between 0.1 and 2.0% by weight of the total composition.

According to one embodiment the mixture including the iron powder and high temperature lubricant may also include a binding agent. This agent might e.g. be selected from cellulose esters. If present, the binding agent is normally used in an amount of 0.01–0.40% by weight of the composition.

Optionally, but not necessarily, the powder mixture including the lubricant and an optional binding agent is heated to a temperature of 80–150° C., preferably 100–120° C. The heated mixture is then compacted in a tool heated to 80–130° C., preferably 100–120° C.

The obtained green bodies are then sintered in the same way as the standard materials, i.e. at temperatures between 1100° C. and 1300° C., the most pronounced advantages being obtained when the sintering is performed between 1120 and 1170° C. as in this temperature interval the warm compacted material will maintain significantly higher density compared with the standard material. Furthermore the sintering is preferably carried out in standard non oxidative atmosphere for periods between 15 and 90, preferably between 20 and 60 minutes. The high densities according to the invention are obtained without the need of recompacting, resintering and/or sintering in inert atmosphere or vacuum.

The invention is illustrated by the following non limiting examples.

EXAMPLES

Example 1

This experiment was carried out with a standard material 434 LHC, available from Coldstream, Belgium, as reference, and water atomised powders having low oxygen, low silicon and low carbon contents (designated Powder A and Powder B respectively) prepared according to the PCT patent application SE 98/01189, referred to above. Six stainless steel mixes having the composition shown in table 1 were prepared according to table 2. Compaction was made on samples of 50 g at 400, 600 and 800 MPa and the green density of each sample was calculated. The warm compaction was carried out with 0.6% by weight of a lubricant of polyamide type and the cold compaction was carried out with a standard ethylene-bis-steramide lubricant (Hoechst wax available from Hoechst AG, Germany). The results are presented in table 3.

TABLE 1

| Powder | % Cr | % Mo | % Mn | % Si | % C | % O | % N | % Fe |
|---|---|---|---|---|---|---|---|---|
| 434L LHC | 16.9 | 1.02 | 0.16 | 0.76 | 0.016 | 0.219 | 0.0085 | Bal. |
| Powder A | 17.6 | 1.06 | 0.10 | 0.14 | 0.010 | 0.078 | 0.0009 | Bal. |
| Powder B | 11.6 | 0.01 | 0.11 | 0.1 | 0.005 | 0.079 | 0.0004 | Bal. |

TABLE 2

| Base powder | Powder temperature (° C.) | Tool temperature (° C.) |
|---|---|---|
| 434 LHC | Ambient temperature | Ambient temperature |
| 434 LHC | 110° C. | 110° C. |
| Powder A | Ambient temperature | Ambient temperature |
| Powder A | 110° C. | 110° C. |
| Powder B | Ambient temperature | Ambient temperature |
| Powder B | 110° C. | 110° C. |

TABLE 3

| Compaction | Conventional compaction | | | Warm compaction | | |
|---|---|---|---|---|---|---|
| pressure (MPa) | 400 | 600 | 800 | 400 | 600 | 800 |
| 434 LHC - Green density (g/cm$^3$) | 5.85 | 6.38 | 6.62 | 5.90* | 6.43* | 6.67* |
| Powder A - Green density (g/cm$^3$) | 6.17 | 6.66 | 6.91 | 6.24 | 6.74 | 7.08 |
| Powder B - Green density (g/cm$^3$) | 6.34 | 6.8 | 7.01 | 6.41 | 6.93 | 7.23 |

*Only two cylinders were compacted due to smearing on the die wall.

This example shows that warm compaction of standard 434 LHC reference powder does not work properly due to high friction during ejection. It also shows that the compressibility (green density) of the low oxygen/carbon stainless steel powder having the low silicon content according to the present invention is increased at elevated temperature and that this effect is especially pronounced at high compaction pressures.

Example 2

The purpose of this investigation was to verify that warm compaction of stainless steel powder is possible also under production like conditions. 30 kg of each of the above powders were mixed. The standard 434 LHC powder was mixed with an ethylen-bisstearamide lubricant and the warm compaction powder was mixed with a high temperature lubricant of polyamide type. 500 parts of each powder sample were pressed in a 45 ton Dorst mechanical press equipped with a heater for heating of the powder and electrical heating of the tooling. The powder was heated to 1100° C. and subsequently pressed in the form of rings in tools heated to 110° C. The rings were pressed at a compaction pressure of 700 MPa and sintered at 1120° C. in hydrogen atmosphere for 30 minutes. On these sintered parts the dimensions, density and the radial crushing strength were measured.

Results from compaction and sintering experiments in an automatic press gave the results given in Table 4.

TABLE 4

| | Conventional compaction Powder 434LHC | Warm compaction Powder 434LHC* | Warm compaction Powder A |
|---|---|---|---|
| Green density | 6.56 | 6.59 | 6.90 |
| Ejection pressure, MPa | 31 | Not stable 40–50 | 35 |
| Springback, % | 0.29 | N/A | 0.25 |
| Green strength, MPa | 16 | N/A | 21 |
| Dimensional change, % | −0.124 | N/A | −0.093 |
| Radial crushing strength, MPa | 457 | N/A | 823 |
| Sintered density, g/cm$^3$ | 6.59 | N/A | 6.91 |
| Sintered height scatter, % | 0.34 | N/A | 0.35 |

*Only 4 rings could be pressed before the tool had to be polished. Therefore no sintering was performed and no values were obtained.

The warm compacted rings showed less springback compared to the standard compacted rings. The green strength increased by 30% from 16 to 21 MPa. The radial crushing strength increased with 80% after sintering which relates strongly to the sintered density of 6.59 g/cm$^3$ for standard and 6.91 g/cm$^3$ for warm compacted. The height scatter decreased during sintering for both compaction series. The height scatter for standard was 0.34% for cold and 0.35% for warm compacted material. This result indicates that the tolerances after sintering are the same for warm compacted material as it is for the standard compaction. The results also indicate that warm compaction of the powder 434LHC is not possible.

What is claimed is:

1. A process of preparing high density, warm compacted bodies of a stainless steel powder comprising the steps of providing a mixture of a low oxygen, low silicon and low carbon stainless steel powder including 10–30% by weight of Cr, optional alloying elements, graphite and inevitable impurities, mixing the powder with a high temperature lubricant and compacting the mixture at an elevated temperature.

2. The process according to claim 1, wherein the oxygen content of the stainless powder is below 0.20% by weight, the silicon content is less than 0.5% by weight, and the carbon content is below 0.03% by weight.

3. The process according to claim 1 wherein the powder includes at least one high temperature lubricant.

4. The process according to claim 3, wherein the lubricant is selected from the group consisting metal stearates, paraffins, waxes, natural and synthetic fat derivatives, and polyamides.

5. The process according to claim 4, wherein the amount of lubricant is between 0.1 and 2.0% of the total composition.

6. The process according to claim 1, wherein the mixture also includes alloying elements and/or graphite.

7. The process according to claim 1 wherein the powder includes at least one binding agent in an amount of 0.01–0.40% by weight of the composition.

8. The process according to claim 1 wherein the powder is preheated to a temperature between 80 and 130° C. before compacting.

9. The process according to claim 1, wherein the powder is compacted in a preheated die at a temperature between 80 and 150° C.

10. The process according to claim 1, wherein the powder is compacted at a pressure between 400 and 1000 MPa.

11. The process according to claim 1, further including the steps of sintering the obtained green bodies at temperatures between 1100° C. and 1300° C. in standard non oxidative atmosphere for periods between 15 and 90 minutes.

12. A powder composition for warm compaction comprising an annealed, water-atomised, essentially carbon free, low oxygen, low silicon stainless steel powder, which in addition to iron, comprises 10–30% by weight of chromium, optional alloying elements, 0–0.4% by weight of graphite, and not more than 0.5% by weight of impurities, and 0.2–2.0% by weight of a high temperature lubricant.

13. The powder composition according to claim 12, wherein the oxygen content of the stainless powder is below 0.2% by weight, the silicon content is less than 0.5% by weight, and the carbon content is below 0.03% by weight of the powder.

14. The composition according to claim 13 comprising, by percent of weight 10–30% of chromium 0–5% of molybdenum 0–15% of nickel 0–1.5% of manganese 0–2% of niobium 0–2% of titanium 0–2% of vanadium 0–5% of $Fe_3P$ 0–0.4% of graphite and at most 0.3% of inevitable impurities, the balance being iron.

15. The composition according to claim 14, comprising, by percent of weight, 10–20% of chromium 0–3% of molybdenum 0.1–0.4% of manganese 0–0.5% of niobium 0–0.5% of titanium 0–0.5% of vanadium and essentially no nickel the balance being iron.

16. The composition according to claim 14, comprising, by percent of weight, 10–20% of chromium 0–3% of molybdenum 0.1–0.4% of manganese 0–0.5% of niobium 0–0.5% of titanium 0–0.5% of vanadium 7–10% of nickel the balance being iron.

17. The composition according to claim 12, wherein the lubricant is a high temperature lubricant selected from the group consisting of metal stearates, paraffins, waxes, natural and synthetic fat derivatives, and polyamides.

18. The composition according to claim 17, wherein the amount of lubricant is between 0.4 and 1.5% by weight of the total composition.

19. The composition according to claim 12, wherein the composition includes at least one binding agent in an amount of 0.01–0.40% by weight of the composition.

20. The process according to claim 1, wherein the oxygen content of the stainless powder is below 0.15% by weight, the silicon content is less than 0.3% by weight, and the carbon content is below 0.02% by weight.

21. The process according to claim 1, wherein the oxygen content of the stainless powder is below 0.10% by weight, the silicon content is less than 0.2% by weight, and the carbon content is 0.01% by weight.

22. The process according to claim 3, wherein the lubricant is lithium stearate.

23. The process according to claim 1, further including the steps of sintering the obtained green bodies at temperatures between 1120 and 1170° C. in standard non oxidative atmosphere for periods between 20 and 60 minutes.

24. A powder composition for warm compaction comprising an annealed, water-atomised, essentially carbon free, low oxygen, low silicon stainless steel powder, which in addition to iron, comprises 10–30% by weight of chromium, optional alloying elements, 0–0.4% by weight of graphite, and not more than 0.5% by weight of impurities, and 0.4–1.5% by weight of a high temperature lubricant.

25. The powder composition according to claim 12, wherein the oxygen content of the stainless powder is below 0.15% by weight, the silicon content is less than 0.3% by weight, and the carbon content is below 0.02% by weight of the powder.

26. The powder composition according to claim 12, wherein the oxygen content of the stainless powder is below 0.10% by weight, the silicon content is less than 0.2% by weight, and the carbon content is below 0.01% by weight of the powder.

27. The composition according to claim 12, wherein the lubricant is lithium stearate.

* * * * *